US005206994A

United States Patent [19]

Lin

[11] Patent Number: 5,206,994

[45] Date of Patent: May 4, 1993

[54] COLLAPSIBLE RAZOR

[76] Inventor: Catherine Lin, 5 F., No. 18-6, King Hua St., Taipei, Taiwan

[21] Appl. No.: 893,443

[22] Filed: Jun. 4, 1992

[51] Int. Cl.[5] ..... B26B 21/40; B26B 21/14

[52] U.S. Cl. ..... 30/47; 30/86

[58] Field of Search ..... 30/86, 41, 47, 57, 125, 30/40, 40.2; 206/228, 352, 354

[56] References Cited

U.S. PATENT DOCUMENTS

| | | | |
|---|---|---|---|
| 4,332,321 | 6/1982 | Wratschko | 30/86 |
| 4,831,729 | 5/1989 | Beuchat | 30/86 |
| 5,010,645 | 4/1991 | Furukawa | 30/47 |

FOREIGN PATENT DOCUMENTS

| | | | |
|---|---|---|---|
| 28911 | 12/1912 | United Kingdom | 30/47 |
| 2166380 | 5/1986 | United Kingdom | 30/47 |

*Primary Examiner*—Douglas D. Watts
*Assistant Examiner*—Hwei-Siu Payer
*Attorney, Agent, or Firm*—Notaro & Michalos

[57] ABSTRACT

A collapsible razor having a handle in the form of a hollow body with a blade cartridge support pivotally mounted thereon to be foldable into the handle body and thus completely encased therein. A container comprising a plurality of chambers is mounted or formed inside the handle body for the disposal of spare blade cartridges.

2 Claims, 4 Drawing Sheets

COLLAPSIBLE RAZOR

FIELD OF THE INVENTION

The present invention relates generally to a razor and in particular to a razor having a blade holder (cartridges) foldable into a casing constituting the razor handle.

BACKGROUND OF THE INVENTION

Conventionally, personal shaving tools comprise essentially razors and shavers (electrical razors). Shavers are a convenient and ready-to-use device. However, a disadvantage of the shavers is the requirement of electrical power. In that respect, wall outlets or batteries are a must for operating the shavers. In case an electrical power supply is not available, shavers are useless.

On the other hand, although manually-operated razors do not need electrical power for operation, the blade edge thereof, which is usually very sharp, needs to be covered or shielded with an overcap to avoid accidently hurting people. However, such a blade overcap is usually made as a separate part of the razors and thus may sometime lost. It is therefore desirable to provide a razor of which the blade holder may be folded into a casing when not in use to shield the sharp blade edge and thus protecting the users.

OBJECTS OF THE INVENTION

The primary object of the present invention is to provide a collapsible razor of which the handle is in the form of a hollow body into which the blade cartridge with the blade disposed thereon is foldable to completely shield the blade edges.

Another object of the present invention is to provide a razor having a plurality of chambers in which spare blade cartridges are respectively disposed.

To achieve the above-mentioned objects, there is provided a collapsible razor having a handle in the form of a hollow body with a blade cartridge support pivotally mounted thereon to be foldable into the handle body and thus completely encased therein. A container comprising a plurality of chambers is mounted or formed inside the handle body for the disposal of spare blade cartridges.

Other objects and advantages of the invention will be apparent from the following description of a preferred embodiment taken in connection with the accompanying drawings wherein:

DETAILED DESCRIPTION OF THE PREFERRED EMBODIMENT

Figure 1:
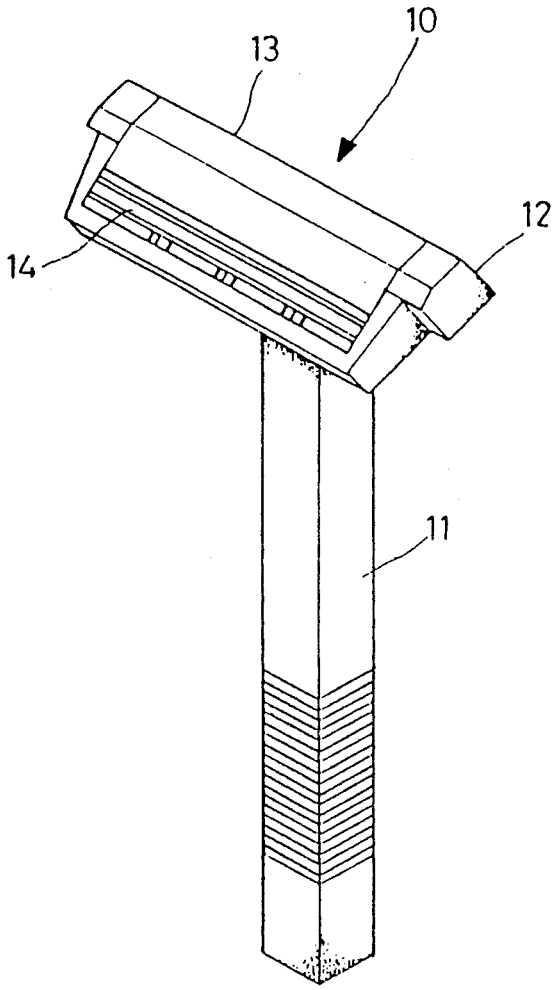
PRIOR ART FIG. 1
FIG. 1 is a perspective view showing a prior art razor.

With reference to FIG. 1, wherein a prior art razor is shown, a prior art razor 10 usually comprises a handle 11 with a blade holder 12 mounted on one end thereof. A blade cartridge 13 with at least a blade 14 mounted therein is removably secured on the blade holder 12. To prevent a user from accidently contacting the blade 14 and thus being hurt, an overcap (not shown) is usually provided to cover the blade edge when not in use. The disadvantage of the prior art razor has been described previously.

Figure 2:
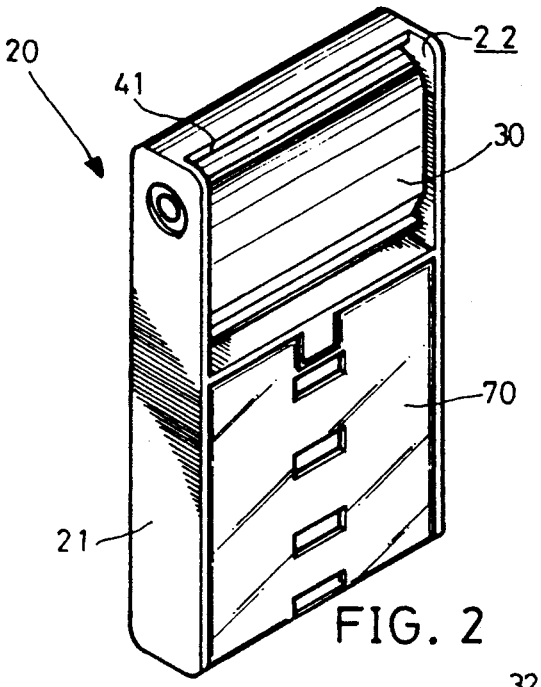
FIG. 2 is a perspective view of a collapsible razor in accordance with the present invention wherein the blade cartridge is folded into the handle body.
Figure 3:
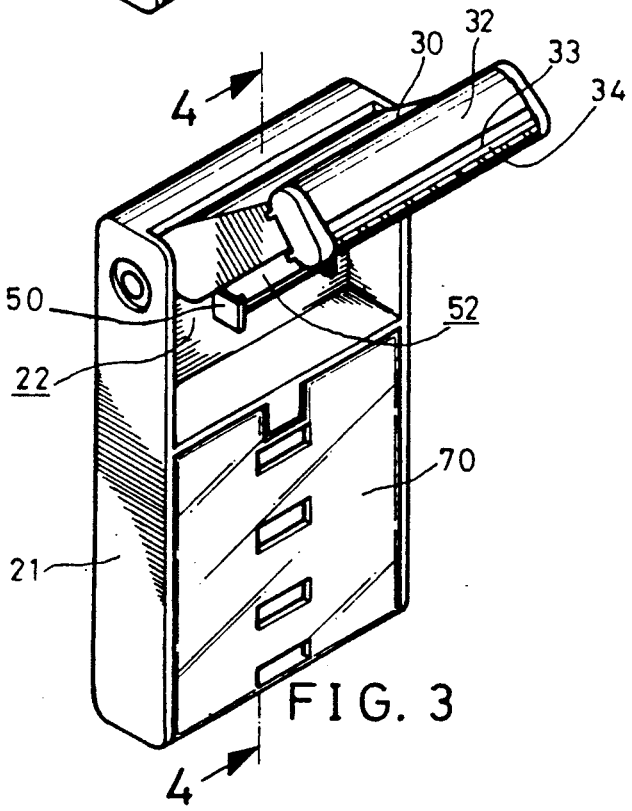
FIG. 3 is a perspective view of a collapsible razor in accordance with the present invention wherein the blade cartridge is pulled out for use.
Figure 4:
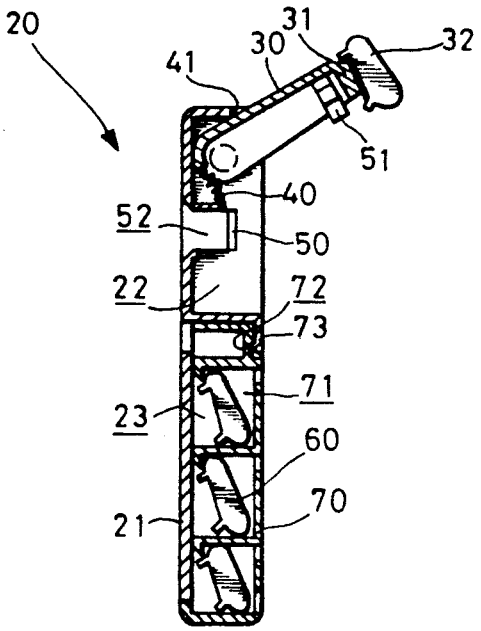
FIG. 4 is a cross-sectional view taken along line 4—4 of FIG. 3.
Figure 5:
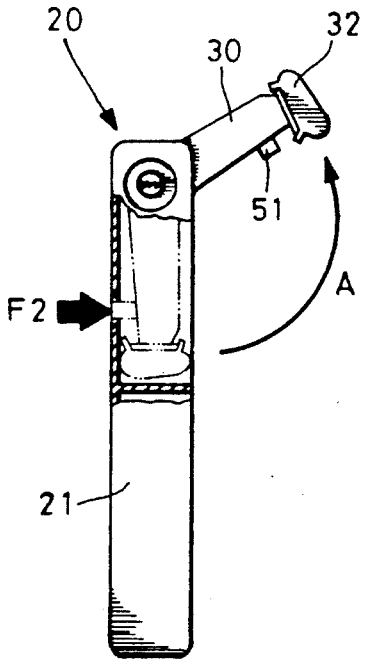
FIG. 5 is a side elevational view showing the pull-out of the blade cartridge.
Figure 6:
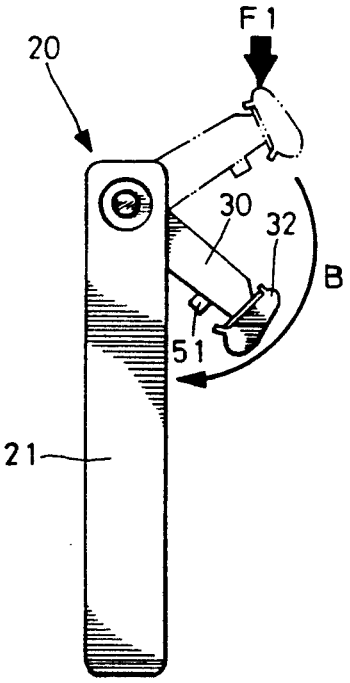
FIG. 6 is a side elevational view showing the collapse of the blade cartridge.

To overcome such disadvantages of the prior art razor, a collapsible razor is provided in accordance with the present invention. With reference to the drawings and in particular to FIGS. 2 to 8, a collapsible razor of the present invention, generally designated with the reference numeral 20, comprises a handle 21 which is a hollow body with a first recess 22 formed thereon. A cartridge support 30, which has an inner end pivotably mounted in the first recess 22 in such a manner as to have the cartridge support 30 rotatable from a first position (as shown in FIG. 2) to a second position (as shown in FIG. 3) along the direction of arrow A of FIG. 5 or from the second position to the first position along the direction of arrow B shown in FIG. 6, has a cartridge holder 31 (see FIG. 4) formed on an outer end with a blade cartridge 32 detachably secured thereon with any known means.

As everybody knows, the blade cartridge 32 usually comprises at least one blade 33 secured therein in such a way to expose a blade edge 34 thereof in order to contact and cut beard or other facial hairs. This is well known to almost everybody, no detail is deemed necessary herein. Also, it is well known to those skilled in the art to devise the detachable securing means of the blade cartridge 32 and thus such or any detachable securing means of the blade cartridge 32 will not be further described herein.

The cartridge support 30 is so pivotably mounted in the first recess 22 of the handle body 21 that when the cartridge support 30 is in the first position, the blade cartridge 32 is at least partially inserted into the first recess 22 and the blade edge 34 completely embedded in and thus completely shielded by the recess 22 to avoid incidentally hurting people (not shown). When the cartridge support 30 is in the second position, the blade edge 34 is exposed and thus ready for shaving as a prior art razor, just like the one shown in FIG. 1.

To maintain the cartridge support 30 in the second position in order to proceed to shave facial hairs, a biasing means 40, preferably a spring, is disposed between the pivotable cartridge support 30 and a stationary part, such as the handle body, to bias the cartridge support 30 toward the second position and against a stopping means 41, preferably an edge of the handle body. The biasing means 40 is so selected that the biasing force thereof is large enough to support the cartridge support 30 and thus the blade cartridge 32 in position for shaving.

With the biasing means 40 so biasing the cartridge support 30, a force F1 (see FIG. 6) or a torque must be applied on the cartridge support 30 against the biasing force to rotate the cartridge support 30 in the direction of arrow B from the second position to the first position thereof. Further, to securely hold the cartridge within the first recess 22 when the razor 20 is not in use, a retaining means 50, preferably in the form of resilient detents, is mounted in the first recess 22 to engage with a counterpart retaining means 51 which may also be a resilient member formed on the cartridge support 30. In a preferred form of the present invention, due to the resilience of the retaining means 50 and its counterpart 51, such an engagement between the retaining means 50 and the counterpart 51 thereof can be released by an external force F2 (see FIG. 5) applied on the cartridge support 30 in the direction of arrow A from the first position toward the second position thereof and thus having the cartridge support 30 sprung out to the second position, ready for shaving.

In a preferred form of the present invention, in order to conveniently apply the external force F2 to the cartridge support 30 to release the engagement between the retaining means 50 and its counterpart 51, an accessing opening 52 may be formed on the handle body 21 in such a location that a user (not shown) may contact the cartridge support 30 to forcibly move the cartridge support 30 and thus releasing the engagement.

A second recess 23 may also be formed on the handle body 21 to serve as a storage means for spare blade cartridges 60. The spare cartridges 60 may be respectively disposed in at least a chamber 71 formed in a container 70. In the embodiment shown in the drawings, there are three chambers with three spare blade cartridges 60 respectively disposed therein. However, any number of chambers and spare blade cartridges can be used. The container 70 has a configuration complementary to the second recess 23 and thus insertable into the recess 23. Means 73 (see FIG. 4), in the form of a nub insertable into a slot 72 formed on the container 70, may be provided in the handle body 21 to retain container 70 within the second recess 23 in a removable way.

Figure 7:
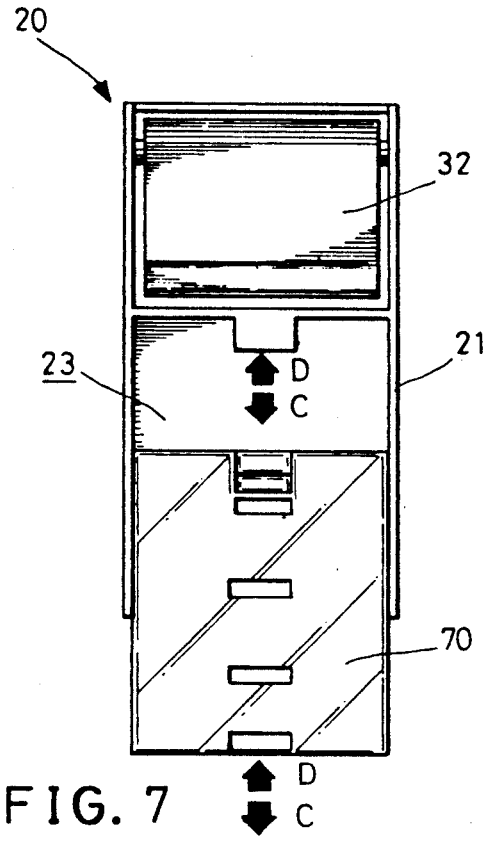
FIG. 7 is a front view showing the disposal and withdrawal of the spare cartridge container.
Figure 8:
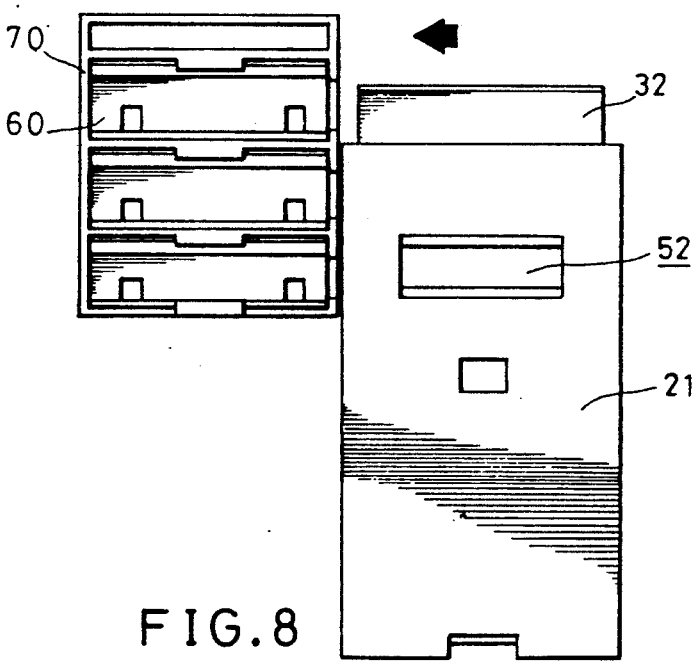
FIG. 8 is a rear side view showing the replacement of the blade cartridges.

In a preferred form of the present invention, as shown in FIG. 7, the container 70 may be released from the handle body 21 along the direction of arrow C shown in FIG. 7 by forcibly pulling the container 70 downward as viewed in FIG. 7. The spare cartridges 60 can then be used to replace the used cartridge 32 as shown in FIG. 8. This is well known to those using prior art razors. No detail will be given herein regarding the exchange of blade cartridges. After the cartridges has been changed, the container 70 may be disposed back into the second recess 23 by being forcibly pushed along the direction of arrow D.

It is apparent that although the invention has been described in connection with a preferred embodiment, those skilled in the art may make changes to certain features of the preferred embodiment without departing from the spirit and scope of the invention as defined in the appended claims.

What is claimed is:

1. A collapsible razor comprising:

a body having a first recess and a second recess thereon, the body having an outer end near the first recess;

a cartridge support pivotably mounted at an inner end thereof in the first recess and rotatable between a first position and a second position, the first position for storing the cartridge support within the first recess of the body, the second position for extending the cartridge support at the outer end of the body and away from the body for shaving;

cartridge holding means mounted to an outer end of the cartridge support for releasably holding a blade cartridge having at least one blade, the blade having at least one blade edge disposed for shaving with the cartridge support in the second position;

stopping means located within the first recess for engaging the cartridge support and stopping the cartridge support when the cartridge support is rotated to the second position;

a biasing means located within the first recess and connected to the cartridge support for biasing the cartridge support toward the second position and against the stopping means;

a retaining means located within the first recess for releasably engaging and securing the cartridge support within the first recess and in the first position, the retaining means receiving the cartridge support upon a force being applied to the cartridge support for rotating the cartridge support from the second position to the first position counteracting the biasing means, the blade cartridge being at least partially inserted into the first recess such that the blade edge is completely shielded within the first recess, the engagement of the cartridge support by the retaining means being releasable for allowing the cartridge support to be sprung out to the second position by the biasing means; and a container releasably insertable into the second recess of the body, the container having at least one chamber thereon for storing a spare blade cartridge.

2. The collapsible razor according to claim 1, wherein the biasing means is a spring acting between the cartridge support and the first recess.

* * * * *